US008391525B2

(12) United States Patent
Severin

(10) Patent No.: US 8,391,525 B2
(45) Date of Patent: Mar. 5, 2013

(54) μ-METAL BARRIER PROVIDED IN CONNECTION WITH THE RECEIVER CASING LID ASSEMBLY

(75) Inventor: Bent Severin, Smørum (DK)

(73) Assignee: Oticon A/S, Smorum (DK)

( * ) Notice: Subject to any disclaimer, the term of this patent is extended or adjusted under 35 U.S.C. 154(b) by 379 days.

(21) Appl. No.: 12/719,581

(22) Filed: Mar. 8, 2010

(65) Prior Publication Data

US 2010/0226518 A1 Sep. 9, 2010

(30) Foreign Application Priority Data

Mar. 9, 2009 (EP) ..... 09154626

(51) Int. Cl.
*H04R 25/00* (2006.01)

(52) U.S. Cl. ..... 381/322; 381/324; 381/330

(58) Field of Classification Search ..... 381/322, 381/324, 330, 381, 189, 418; 181/129, 130, 181/135

See application file for complete search history.

(56) References Cited

U.S. PATENT DOCUMENTS

| | | | | |
|---|---|---|---|---|
| 4,620,605 | A * | 11/1986 | Gore et al. | 181/135 |
| 5,204,917 | A * | 4/1993 | Arndt et al. | 381/324 |
| 2006/0013432 | A1 * | 1/2006 | Husung | 381/396 |

FOREIGN PATENT DOCUMENTS

| | | | |
|---|---|---|---|
| DE | 87 13 089 | U1 | 1/1989 |
| EP | 0 466 961 | A1 | 1/1992 |
| EP | 1 617 706 | A2 | 1/2006 |
| WO | WO 2005/055652 | A1 | 6/2005 |

* cited by examiner

*Primary Examiner* — Huyen D Le
(74) *Attorney, Agent, or Firm* — Birch, Stewart, Kolasch & Birch, LLP

(57) ABSTRACT

A hearing aid may include a housing shaped to rest behind an ear of a user, electric circuitry, a microphone, an antenna which receives wireless signals, a signal processor, a receiver, and a sound guide configured to sound from the receiver towards the ear. An enclosure may be provided for sound isolation of the receiver and includes a detachable lid providing access to the enclosure. A suspension body may be attached to a first suspension area and a second suspension area of the lid. The suspension body holds the receiver suspended within the enclosure. The suspension body includes suspension members connected to the suspension areas of the lid. The suspension members include protrusions that form a shelf that holds a metal shield plate between the lid and the receiver and spaced away from the receiver.

4 Claims, 5 Drawing Sheets

μ-METAL BARRIER PROVIDED IN CONNECTION WITH THE RECEIVER CASING LID ASSEMBLY

TECHNICAL FIELD

The present invention relates to the area of hearing aids comprising wireless connection means. The invention relates specifically to a hearing aid comprising a housing shaped to rest behind the ear of a user, where the housing encloses electric circuitry which interconnects power input terminals or battery terminals, a microphone which converts a sound signal into an electric signal in the circuitry, an antenna which converts possible wireless signals into electric signals in the circuitry, a signal enhancer or amplifier which amplifies the electric signals from the microphones and/or from the antenna, a receiver unit which receives the amplified signal from the amplifier and produces sound waves, sound guiding means which are arranged to guide the sound from the receiver unit towards the ear of the user, where an enclosure is provided within the housing for sound isolation of the receiver, where access to the enclosure is granted by means of a detachable lid and were the receiver is flexibly suspended for free movement from the lid at a first suspension area and a second suspension area distanced from said first suspension area.

The invention may e.g. be useful in applications such as hearing aids and wireless headsets and or similar miniature apparatuses for feeding a sound signal into the ear of a user while at the same time receiving a wireless signal from an antenna element.

BACKGROUND ART

The following account of the prior art relates to one of the areas of application of the present invention, namely that of the hearing aid industry. In hearing aids it is customary to provide a telecoil, which is responsive primarily to changes in the magnetic flux in the surroundings. Such a telecoil is responsive eg to the magnetic flux changes induced by the small loudspeakers in telephone handsets, and this allows hearing aid users to speak on the phone while receiving the audio signal from the telephone via the telecoil, which will aid the hearing aid user when speaking on the phone. Further, there is now provided tele-loop installations at many public areas such as in churches, concert halls, movie theatres and also in private homes such installations has been in use for a long time. When a hearing aid user has a hearing aid with a telecoil antenna, the user may then receive the signal transmitted via the teleloop installation in the area and this is often a better and clearer signal, than is the signal provided from the microphones of the hearing aid. It has been a long known problem, that the telecoil will inevitably also respond to the magnetic signal leaked from the nearby speaker (called a receiver) of the hearing aid itself, and this will lead to a very annoying noise for the user. It has been the customary practice to enclose the receiver in a metal housing, composed of a metal composition known as mu-metal or μ-metal. This material will effectively isolate the receiver and the coil within the receiver from the telecoil. However this is a rather expensive procedure, and valuable real estate within the hearing aid is used which makes the hearing aid look bulky and less attractive to the user. Alternatively various shields or screens of mu-metal have been used, but such screens are difficult to insert in a hearing aid constructions without making fundamental changes in constructional details of the hearing aid, especially so, when the hearing aid comprises a hermetically closed chamber for the receiver.

DISCLOSURE OF INVENTION

The problem of the prior art is that there appears to be no simple solution to the problem of providing shielding of the receiver in a hearing aid casing which comprises a hermetic enclosure for the receiver, especially so when the fundamental design of the hearing aid casing should not be changed, such that fundamentally the same construction of the hearing aid may be used without the shield.

An object of the present invention is to provide a construction which allows the insertion of a mu-metal shield in a hearing aid comprising a receiver enclosure, without fundamentally changing the design of the hearing aid.

Objects of the invention are achieved by the invention described in the accompanying claims and as described in the following.

An object of the invention is achieved by a hearing aid comprising a housing shaped to rest behind the ear of a user, where the housing encloses electric circuitry which interconnects power input terminals or battery terminals, a microphone which converts a sound signal into an electric signal in the circuitry, an antenna which converts possible wireless signals into electric signals in the circuitry, a signal enhancer or amplifier which amplifies the electric signals from the microphones and/or from the antenna, a receiver unit which receives the amplified signal from the amplifier and produces sound waves, sound guiding means which are arranged to guide the sound from the receiver unit towards the ear of the user, where an enclosure is provided within the housing for sound isolation of the receiver, where access to the enclosure is granted by means of a detachable lid and were the receiver is flexibly suspended for free movement from the lid at a first suspension area and a second suspension area distanced from said first suspension are wherein the hearing aid comprises metal shield plate which is provided between the receiver and the lid extending from the first to the second suspension area.

The advantage of the invention is that the hearing aid may be made with the shield in place when this is required, and for other models, the shield may be omitted, without basically changing the design of any further parts of the hearing aid. This is achieved by providing the shield in the area between the lid of the receiver enclosure and the receiver suspended therefrom and extending from the first to the second of the suspension areas. In this way the shield may be slid easily into place between the suspensions, and once the lid with the receiver and the shield is mounted the shield will be prevented from moving away from the lid.

Further objects of the invention are achieved by the embodiments defined in the dependent claims and in the detailed description of the invention.

As used herein, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements maybe present, unless expressly stated otherwise. Furthermore, "connected" or "coupled" as used herein may include wirelessly connected or coupled. As used herein, the term "and/or" includes any and all combinations of one or more of the associated listed items.

BRIEF DESCRIPTION OF DRAWINGS

The invention will be explained more fully below in connection with a preferred embodiment and with reference to the drawings in which.

Figure 1:
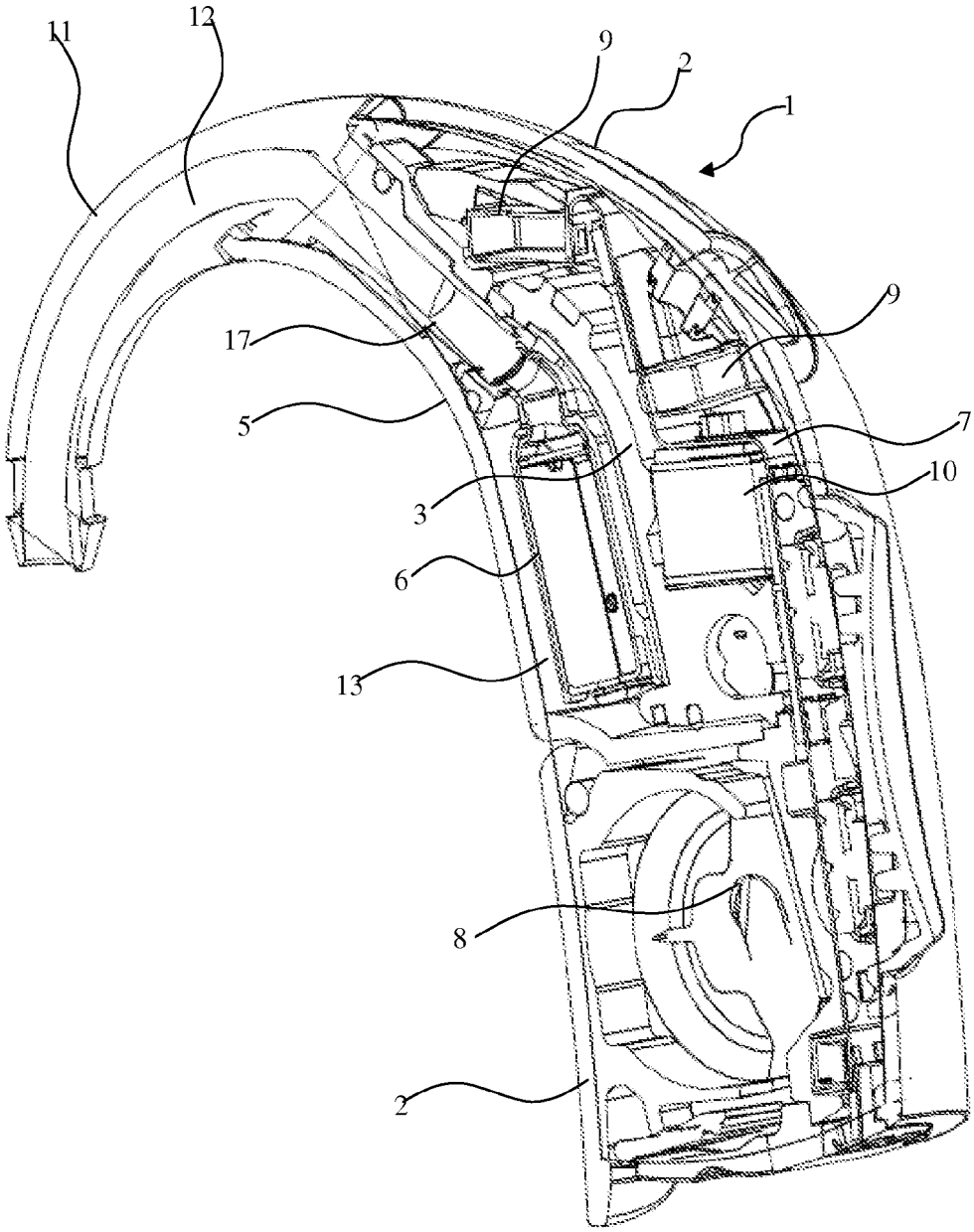
FIG. 1 shows a section through a hearing aid according to the invention in a 3d projection view.

The figures are schematic and simplified for clarity, and they show details which are essential to the understanding of the invention, while other details may be presented in the drawings without being referred to in the text as they have no bearing on the invention, or they may be left out. Throughout, the same reference numerals are used for identical or corresponding parts.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

FIG. 1 shows a section through a hearing aid according to the invention in a 3d projection view. In the figure the following vital parts of the hearing aid 1 are shown: the housing 2 which is shaped to rest behind the ear of a user and thus has an elongate shape. At the upper end of the housing 2 a hook shaped extension 11 which serves to keep the housing in place behind the ear flip of the user is provided. The hook 11 has a hollow bore 12 which is in communication with the receiver 6 for feeding the sound signals therefrom toward the ear of the user. The housing 2 encloses electric circuitry, which in the present case comprises a flexible printed circuit board 7, also known in the art as a flexprint, onto which circuitry elements such as IC devices and capacitors are mounted and connected with electric lanes embedded in the flexprint material. The IC functions as a signal enhancer or an amplifier which amplifies the electric signals from the microphones 9 and/or from the antenna 10. The flexprint 7 interconnects power input terminals or battery terminals 8, the microphones 9 which converts a sound signal into an electric signal in the circuitry, the antenna 10 which converts possible wireless signals into electric signals in the circuitry, a receiver unit 6 which receives the amplified signal from the amplifier and produces sound waves. In connection with the receiver 6 sound guiding means 12,17 are provided which are arranged to guide the sound from the receiver unit 6 towards the ear of the user (not shown). As seen in FIG. 1 an enclosure 13 is provided within the housing 2 for sound isolation of the receiver 6, and access to the enclosure 13 is granted by means of a detachable lid 3. The receiver 6 is flexibly suspended for free movement from the lid 3 at a first suspension area 14 and a second suspension area 15 distanced from said first suspension area as best seen in FIG. 3.

Figure 2:
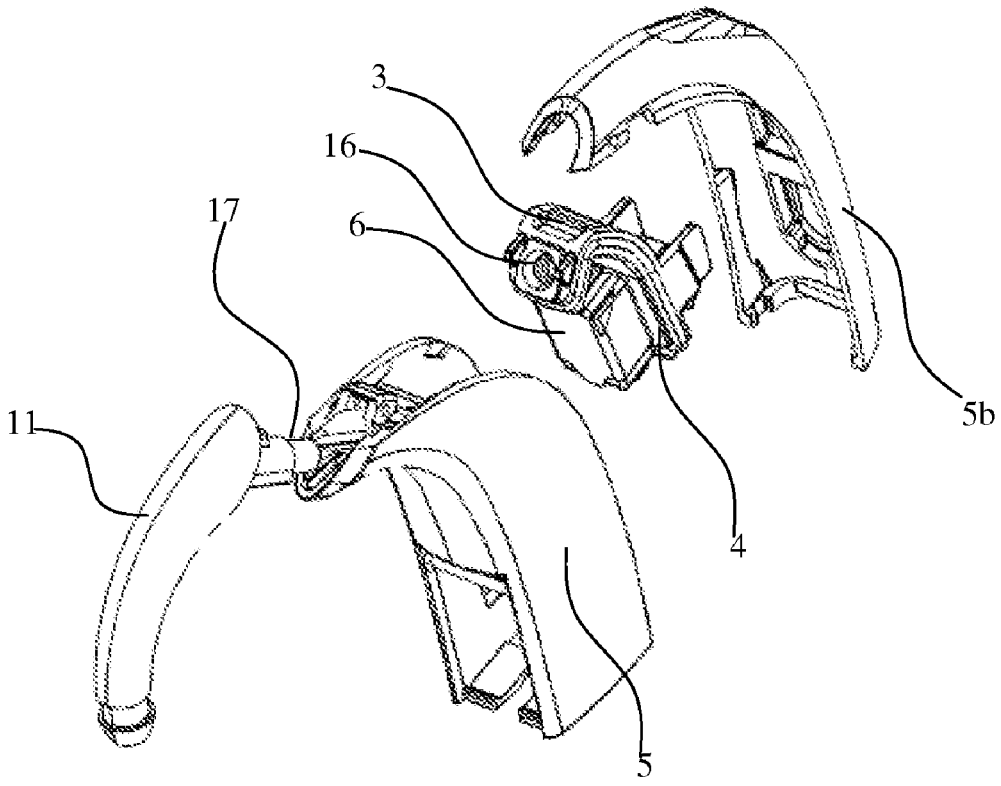
FIG. 2 shows details of the hearing aid according to the invention in an exploded view.

FIG. 2 shows details of the hearing aid according to the invention in an exploded view, the details comprising the lid 3, the shielding metal plate 4, a base part 5 of the hearing aid casing 2 and the receiver 6 suspended from the lid 3. A top shell part 5*b* is also shown. The hook 11 is also shown drawn out of the base part 5. The lid 3 has a opening 16 in a foremost part thereof, and when the lid 3 is introduced into the base part 5, the hook 11 may be inserted into the front end of the base part such that a tube 17 extending from the hook 11 may penetrate into the opening 16.

Figure 3:
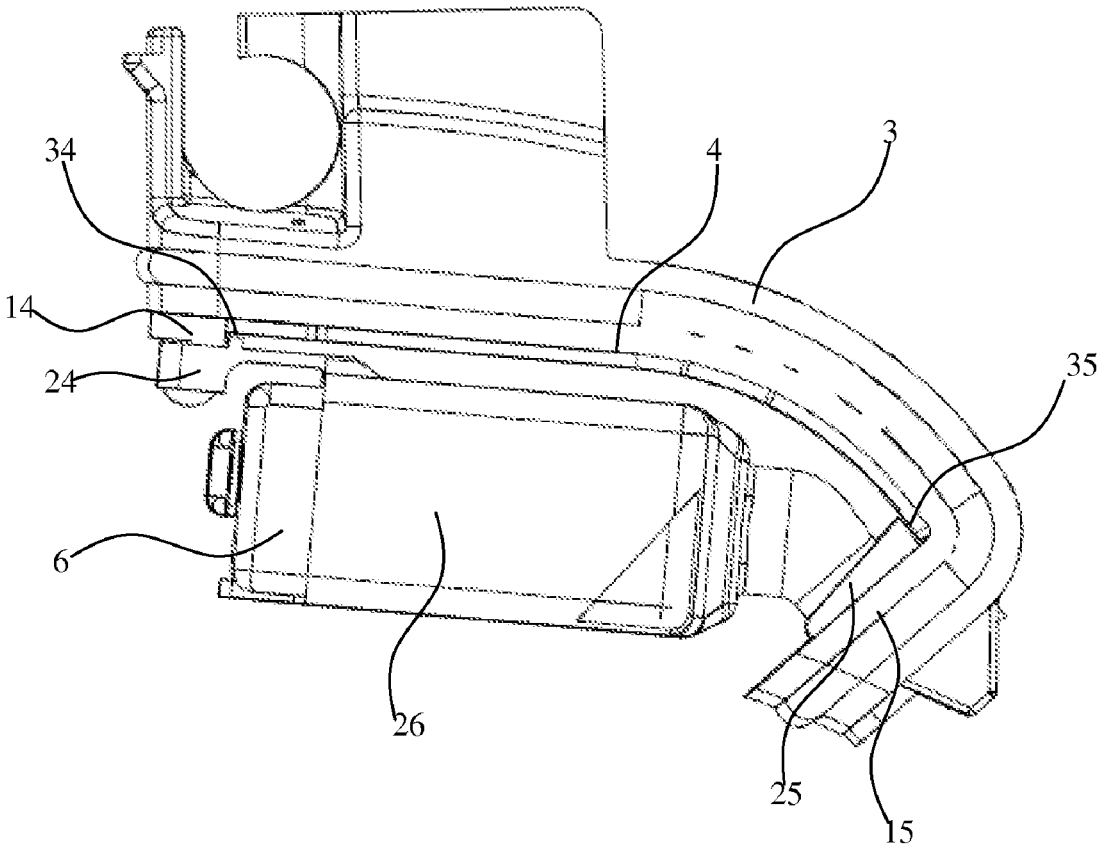
FIG. 3 shows the receiver, the lid and the shield plate in a side view.

FIG. 3 shows he receiver 6, the lid 3 and the shield plate 4 in a side view. The suspension areas 14, 15 of the lid 3 are shown, and attached to the suspension areas are front and rear suspensions 24, 25. The front suspension 25 is shaped as a hollow tube which has an outer recess, such that it may be introduced into the opening 16 and in this way be suspended from the lid 3. The front and rear suspensions 24, 25 are interlinked by a body part 26 shaped to fit snugly around the receiver 6. When the tube 17 is inserted into the hollow tube of the front suspension 25 in the opening 16 and the receiver 6 is placed in the body part 26 a sound tight tube is provided from the receiver 6 and to the tip of the hook 11.

Figure 4:
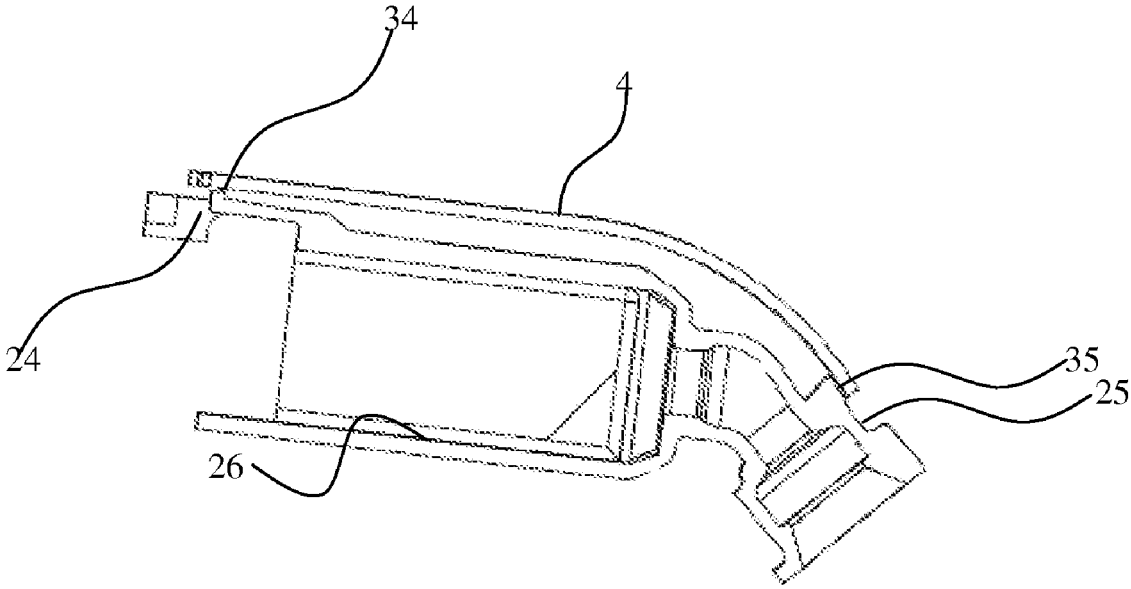
FIG. 4 shows the suspension means and the shield plate in a sectional view from the same side as the side view of FIG. 3.

FIG. 4 shows he suspension means and the shield plate 4 in a sectional view from the same side as the side view of FIG. 3. The rear suspension 24 has a rear shelf 34, and the front suspension 25 has a front shelf 35, and the shielding plate 4 rests on the two shelves 34, 35 distanced from the receiver 6 which may move freely in all directions due to the flexible nature of the construction material used for the front and rear suspensions 24,25 and for the body part 26.

Various fixtures are provided on the top side of the lid 3 in order to receive different parts of the hearing aid, and notably a fixture is provided for the antenna 10 above the receiver 6. The close proximity of the antenna 10 and the receiver 6 is a problem as previously described, but with the shielding plate 4 in place between the two elements the magnetic fields from the receiver will be less likely to generate un-wanted noise signals in the antenna or telecoil 10.

Preferably the shielding plate 4 is 0.18 and 0.25 in the thickness, and most preferably the thickness measure is 0.22 mm. The area of the plate 4 is chosen to ensure, that the receiver is well covered by the plate, and preferably the area of the plate is 46 $mm^2$, whereas the area of the projection of the receiver against the plate is 22 $mm^2$.

In certain cases further measures will be necessary, as described in the following with reference to FIG. 5 which shows the inside of the receiver.

Figure 5:
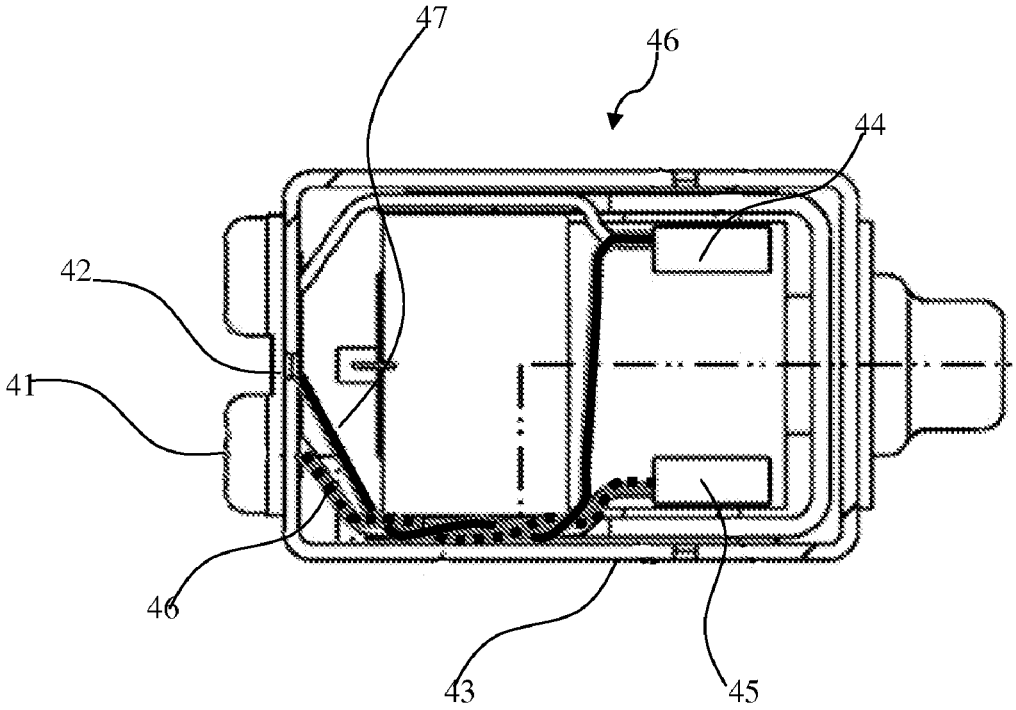
FIG. 5 shows the inside of the receiver.

FIG. 5 shows the inside of the receiver 6 with external connection points 41, 42 for leads coming from the circuitry 7 of the hearing aid. The leads are not shown but may preferably comprise a pair of wires, possibly running as a twisted pair. The receiver has a metal housing 43 and within the housing, two connection terminals 44, 45 for the input signal. Inside of the housing, two leads 46, 47 are arranged to establish connection from the housing internal side of the connection points 41, 42 to the terminals 44, 45. As seen in the Figure, the two leads 46,47 are caused to follow one internal side of the housing 43 as a twisted lead pair, towards the one terminal 45, where the two leads parts, and the one lead connects to terminal 45 and the other lead spans the width of the housing 43 and connects the second terminal 44. This particular way of running the leads from the connection points 41, 42 to the terminals 44, 45 assures that the electromagnetic noise from the receiver will be diminished, and in unison with the previously described shielding plate 4 will assure that the noise from the receiver 6 does not affect the telecoil.

The invention claimed is:

1. A hearing aid, comprising:

a housing shaped to rest behind an ear of a user, the housing enclosing electric circuitry which interconnects power input terminals or battery terminals, a microphone which converts a sound signal into an electric signal in the circuitry, an antenna which converts possible wireless signals into electric signals in the circuitry, a signal enhancer or amplifier which amplifies the electric signals from the microphone and/or from the antenna to produce an amplified signal, a receiver unit which receives the amplified signal and produces sound waves, a sound guide configured to guide the sound waves from the receiver unit towards the ear of the user;

an enclosure provided within the housing for sound isolation of the receiver, the enclosure including a detachable lid providing access to the enclosure, the receiver flexibly suspended for free movement from the detachable lid at a first suspension area of the detachable lid and a second suspension area of the detachable lid, distanced from said first suspension area;

a metal shield plate provided between the receiver and the detachable lid, the metal shield plate extending from the first suspension area to the second suspension area;

a suspension body made of a soft flexible material configured to hold the receiver;

a first suspension member extending from a first end of the suspension body and connected to the first suspension area of the detachable lid; and a second suspension member extending from a second end of the suspension body and connected to the second suspension area of the detachable lid, wherein the first suspension member includes a first shelf spaced apart from the detachable lid, the second suspension member includes a second shelf spaced apart from the detachable lid, and the metal shield plate rests on the first shelf and the second shelf and is distanced from the receiver by the shelves.

2. The hearing aid as claimed in claim 1, wherein the antenna is provided above the metal shield at an upper side of the lid.

3. The hearing aid as claimed in claim 2, wherein two wires are externally soldered to connection points on a receiver housing, and two wires internally in the receiver housing interconnect said connection points from an inside wall of the receiver housing and pass as a twisted lead pair from the connection points to a first terminal and a second terminal of the receiver.

4. A hearing aid, comprising:

a housing shaped to rest behind an ear of a user;

electric circuitry which interconnects power input terminals or battery terminals;

a microphone which converts a sound signal into an electric signal in the circuitry;

an antenna which converts possible wireless signals into electric signals in the circuitry;

a signal enhancer or amplifier which amplifies the electric signals from the microphone and/or from the antenna to produce an amplified signal;

a receiver unit which receives the amplified signal and produces sound waves;

a sound guide configured to guide the sound waves from the receiver unit towards the ear of the user;

an enclosure provided within the housing for sound isolation of the receiver, the enclosure including a detachable lid providing access to the enclosure, the detachable lid including a first suspension area and a second suspension area, distanced from the first suspension area, the receiver flexibly suspended at the first suspension area and the second suspension area;

a suspension body made of a soft flexible material configured to hold the receiver;

a first suspension member extending from a first end of the suspension body and connected to the first suspension area; and a second suspension member extending from a second end of the suspension body and connected to the second suspension area, wherein the first suspension member includes a first protrusion extending in a direction toward the detachable lid, an anterior surface of the first protrusion forming a first shelf spaced apart from the detachable lid, the second suspension member includes a second protrusion extending in a direction toward the detachable lid, an anterior surface of the second protrusion forming a second shelf spaced apart from the detachable lid, and a void is formed between the first shelf, the second shelf, and a surface of the detachable lid, the void being configured to receive and hold a metal shield plate distanced from the receiver.

* * * * *